United States Patent [19]

Taylor

[11] 4,325,553

[45] Apr. 20, 1982

[54] LOW ANGULAR ACCELERATION PUTTER AND METHOD

[76] Inventor: Dale W. W. Taylor, P.O. Box 245, Carmel Valley, Calif. 93924

[21] Appl. No.: 16,436

[22] Filed: Mar. 1, 1979

Related U.S. Application Data

[63] Continuation-in-part of Ser. No. 873,109, Jan. 30, 1978, abandoned.

[51] Int. Cl.[3] ..... A63B 53/04

[52] U.S. Cl. ..... 273/167 F; 273/167 G; 273/171

[58] Field of Search ..... 273/77 R, 77 A, 78, 273/164, 167-175, 183 D, 80 C

[56] References Cited

U.S. PATENT DOCUMENTS

| | | | |
|---|---|---|---|
| D. 240,249 | 6/1976 | Chellman | 273/167 F X |
| 1,320,163 | 10/1919 | Maurice | 273/171 |
| 1,518,316 | 12/1924 | Ellingham | 273/171 |
| 1,666,174 | 4/1928 | Holland | 273/169 X |
| 1,917,774 | 7/1933 | Ogg et al. | 273/167 F |
| 2,174,212 | 9/1939 | Newsome | 273/167 F X |
| 2,231,847 | 2/1941 | Dickson et al. | 273/169 X |
| 2,926,913 | 3/1960 | Stecher | 273/167 G X |
| 3,212,783 | 10/1965 | Bradley et al. | 273/171 |
| 3,305,235 | 2/1967 | Williams | 273/169 X |
| 3,516,674 | 6/1970 | Scarborough | 273/169 |
| 3,625,518 | 12/1971 | Solheim | 273/167 F X |
| 3,762,717 | 10/1973 | Johnston | 273/167 G X |
| 3,921,984 | 11/1975 | Winter | 273/167 F X |
| 3,954,265 | 5/1976 | Taylor | 273/167 G X |
| 3,955,820 | 5/1976 | Cochran et al. | 273/167 F |
| 3,966,210 | 6/1976 | Rozmus | 273/169 |
| 3,967,826 | 7/1976 | Judice | 273/167 F |
| 4,063,733 | 12/1977 | Benedict | 273/167 G X |

FOREIGN PATENT DOCUMENTS

| | | | |
|---|---|---|---|
| 304008 | 1/1929 | United Kingdom | 273/169 |
| 1232651 | 5/1971 | United Kingdom | 273/169 |

*Primary Examiner*—Richard J. Apley

*Attorney, Agent, or Firm*—Flehr, Hohbach, Test, Albritton & Herbert

[57] ABSTRACT

A golf putter constructed to minimize angular acceleration during the period of impact. Specifically, a golf putter having a shaft and a head, the head having a striking face, heel and toe portions. The moment of inertia of the effective mass of the toe portion of the head is balanced, with reference to the center of the striking face, with the moment of inertia of the effective mass of the heel portion of the head plus the effective mass of the shaft, under the dynamic conditions of impact. In such dynamic state, the putter combines a high moment of inertia with location of the center of effective mass at the center of the striking face, such construction unexpectedly minimizing the torque resulting from an imperfect impact so as to cause the putt to have less deflection from the perfect line.

The putter is designed and balanced so that the bulk of the effective mass of the putter, as just described, is as far as possible from the center of the striking face, and so that the center of effective mass is as close to the center of the striking face (the conventional preferred point of contact) as possible. The mass for determining effective mass and the center of the effective mass constitutes that portion of the shaft which is operable during the period of impact along with the mass of the head. That is to say that portion of the shaft and the head which react to or "feel" the shock waves of the impact before the ball leaves the striking face. The putter is face-balanced by rotating an offset curved portion of the shaft with respect to its longitudinal axis and the mounting means.

13 Claims, 12 Drawing Figures

LOW ANGULAR ACCELERATION PUTTER AND METHOD

CROSS REFERENCE TO RELATED APPLICATION

This application is a continuation-in-part of my earlier filed application, Ser. No. 873,109, filed Jan, 30, 1978, now abandoned.

BACKGROUND OF THE INVENTION

It has been an enigma amongst golfers both amateurs and professionals, as to why some putters work better than others. This is not always a question of skill in use, although this is a factor, but by and large it has been the experience of all types of golfers that some putters give a better performance in anyone's hands, than others.

Recently, the capabilities and performance of existing putters have been the subject of investigation and serious study. So far as is known, no existing putter has involved a design which featured a structure to function in accordance with the principles of the mechanics of motion as opposed to static mechanics. In particular, none has been structured to minimize the onset of twisting (viz., angular acceleration) of the putter during the period of impact, while maintaining a high and stable moment of inertia.

A moment's observation shows that the act of putting is that of striking a golf ball on a putting green with a putter in a predetermined direction and at a predetermined distance, with sufficient force to have the ball travel to and drop into the hole. If the golfer incorrectly determines the direction, which is the aim, and/or incorrectly determines the force to be applied to the ball, the putt will be a failure in that the ball will not fall into the hole. If the determination of direction and force (and the execution) are correct, the putt should be a success. Both alignment and force are the conscious acts of the golfer. Alignment has been studied for the purpose of helping the golfer make a correct determination of the direction or aim. Great help has been given to the golfer by putters supplied in recent years under the "ZEBRA" trademark, (see U.S. Pat. No. 3,954,265), with multiple equal and alternate stripes over a substantial area of the top surface of the head. This has greatly aided in making correct aim possible with a minimum of conscious determination by the golfer.

The stripes so provided have been an aid in striking the ball on the correct alignment in the so-called "sweet spot". This point has traditionally been considered the center of the putter's striking face without understanding or even agreement as to the reasons for this, or consideration and incorporation of the principles in the design of a putter which would make these results scientifically true. The problem of determining the "sweet spot" has been a fuzzy one over the years. However, the most important feature of a putter is the way in which it reacts in making a putt. This involves the mechanics of motion, and so far as is known, no putter has been designed with respect to the mechanics of motion.

This prompted recent studies which have established that if a ball is struck with the correct force (which is the force applied at the moment of impact and which equals the mass of the golfer-putter unit multiplied by the acceleration of the golfer-putter unit), and this force is correctly applied at the center of the striking face, then the golf ball will be propelled along a correct line toward the hole if and only if the center of effective mass is at or closely adjacent to the center of the striking face. In this study it was also discovered that if the mass of the putter is increased, the acceleration of the golfer-putter unit is less to accomplish the same result under the same circumstances. This of course must be within the limits of an acceptable club head.

Assume the dynamic condition of a putting stroke wherein a putter is advancing toward the ball in the proper direction with its face normal to that direction. If the impact is in every way perfect, the club will continue in the same direction with its face normal to the direction of the putting stroke. In such case, the design of the putter is essentially irrelevant. Of course, such condition almost never occurs due to normal golfer-putter irregularities which affect the putting stroke. Accordingly, immediately after impact, the face is no longer normal to the initial direction of the putting stroke—indicating that something happened during impact. What happened is that the putter face developed angular velocity in addition to its initial linear velocity so that the face is "twisting". The initiation of this angular velocity is angular acceleration. That is to say, before the impact, the angular velocity of the culb face was zero whereas, after impact, the angular velocity has become something greater than zero. This change of state is "angular acceleration" and it occurs during the period of impact. It is the angular acceleration during impact that sends the ball of line and short of its intended distance. After the impact period, there remains angular velocity, but not angular acceleration. Therefore, it is only angular acceleration and the short period of impact that are of importance.

In the light of the foregoing considerations, it became clear that a putter which would minimize angular acceleration (at impact) would be highly desirable. Therefore, attention was given to the relevant equation, in physics, as follows:

$$\alpha = T/I$$

Where $\alpha$ = angular acceleration

T = torque

I = moment of inertia

From the foregoing, it becomes apparent that to minimize angular acceleration, the putter construction should be such as to both minimize torque and maximize moment of inertia at the moment of impact. It is also essential to define the precise structure for which the torque is to be minimized and the moment of inertia is to be maximized. Specifically, some parts of the golfer-putter unit are relevent and some are not. To differentiate between the relevant and nonrelevant components, it is necessary to understand precisely what happens at impact. In this regard, the putter-ball impact lasts over a short period of time; after the ball leaves contact with the face, subsequent happenings no longer affect the behavior of the ball. The period of contact is therefore all-important. During contact, shock waves reverberate inside the putter head to effect its (and the ball's) behavior. Moreover, shock waves reach up the shaft. The mass of that portion of the shaft that "feels" the shock wave before the ball leaves the face is the reactive or "effective" component that affects the ball's behavior. The rest of the shaft has no effect on the ball. By the time the golfer feels the impact, the ball has left the club face so that the mass of the golfer has no effect on the putt.

The center of effective mass is that point separating the effective mass into two parts which have equal moments of inertia. The center of effective mass is the "sweet spot", and at no other point of contact will the ball and head not deflect.

Thus, three effective masses must be considered and properly defined. First, the entire effective mass, that is, the sum total of all masses that "feel" the shock of impact before the ball leaves the face. Second and third are the "toe side" and "heel side" portions of the effective mass, each of which has the same moment of inertia as the other.

It has been further observed in our studies, that if the impact occurs elsewhere than at the "sweet spot" of the putter, as correctly defined above, the ball will be propelled incorrectly and will have a force vector which will cause the ball to vear to the left or to the right, and therefore fail as a putt. As indicated above (and presently understood) this is because of the angular acceleration developed in the club face during the period of impact. Of course, the golfer is not aware of what causes his mis-putt and probably is not interested in the scientific explanation. However, one involved in putter design can (and should) provide an implement designed to improve the golfer's putt. Also one can (and should) explain the proper use of the implement, if not its scientific design parameters.

SUMMARY OF THE INVENTION

In perfecting the present invention, a study was undertaken to discover a putter design which would minimize the amount of angular acceleration resulting from an imperfect hit, and thus give an imperfect putt a straighter roll than was heretofore possible and a greater opportunity for the ball to reach and drop into the hole. Specifically, the design efforts were directed to creating a putter construction which would minimize angular acceleration by minimizing the amount of torque during the period of impact, and by providing a high or maximum moment of inertia. In connection with these experiments and studies it was unexpectedly found that a putter with a very high moment of inertia will deflect less, given a miss hit or torque, than a putter of a low moment of inertia. Also it was unexpectedly discovered that the effective mass of the putter during the period of impact includes a specific portion of the shaft. It was not known previously how much of the shaft was involved in making a putt at the moment of impact, if indeed, any portion was to be considered, much less that the effective portion of the shaft's mass was to be included in the determination of the effective mass of the head. However, it has now been determined that to minimize angular acceleration, the effective mass of the putter head must be correctly determined, and such mass has been found to reside in the toe and heel of the putter head and in the effective portion of the shaft. The moment of inertia depends on how far the preponderance of this effective mass is from the center of effective mass. It was also unexpectedly determined that the center of effective mass should be as close to the center of the striking face of the club as possible, since the golfer attempts to strike the ball there.

From these discoveries the relevant formulas can be stated as follows:

$$\alpha = T/I$$

$$T = Fh$$

$$I = \sum_{i=1}^{N} m_i r_i^2$$

where $\alpha$ = angular acceleration

T = torque

I = moment of inertia

F = force of the impact h = the distance between the center of effective mass and the line of force of the impact.

$m_i$ = mass of the $i^{th}$ particle $r_i^2$ = the square of the distance between the $i^{th}$ particle and a line perpendicular to the face passing through the center of effective mass $$\sum_{i=1}^{N} =$$

the summation of all the products $m_i r_i^2$ over i from one to N, the number of particles.

Consideration of the foregoing led to the further discovery that whereas the development of a high moment of inertia depends upon the degree of displacement of the effective mass from the center of effective mass as well as the amount of mass, the advantage of low angular acceleration is developed only by the careful balancing of the effective masses about such center of effective mass. That is to say, the present invention considers moment of inertia in terms of how far from the center of effective mass the mass is, how much mass is involved, and the degree of angular acceleration in terms of a spaced equalization of the moment of inertia of the effective masses about the center of mass. The purpose or goal of the present invention is therefore to provide a golf putter which has the dynamic characteristics during the period of impact of low angular acceleration caused by low torque combined with a high moment of inertia, thereby providing each putt with the greatest opportunity for achieving the desired result (i.e., having the ball travel to and drop into the hole).

It is noted that most of the effort in determining the "sweet spot" of the putter has previously been directed towards locating the center of gravity of the head alone, without knowledge or concern as to what constituted the effective mass of the putter. Therefore, such efforts were at best only determinative of the center of mass of the head alone. In contrast, the present invention is not concerned with the static activity of gravity as influencing the striking of the ball and minimizing the effects of an imperfect hit, or with the determination of the center of mass of the head alone. All present teachings and thought (prior to the present invention) therefore lead away from the discovery disclosed herein, and were antithetical to its accomplishment.

It is a principal object of the present invention therefore to provide a golf putter which, under the dynamic conditions of a putting stroke, is constructed to minimize the angular acceleration of the striking face during the period of impact by minimizing torque and maximizing the moment of inertia of the effective mass of the putter.

It is another object of the invention to provide a golf putter of such character which has a high moment of inertia in that the effective mass of the putter is displaced as far as possible from the center of its effective mass which, in turn, is as close as possible to the center of the striking face, the intended point of impact.

It is still the further ojective of the present invention to provide a scientifically designed putter of such character which will hit and propel a golf ball straighter than any previous putter due to its properly defined and located center of effective mass.

Golfers have been taught and encouraged to strike the ball at the center of the striking face. No reason was ever given but, as this disclosure shows, if the center of effective mass does not coincide with the center of the face, a mass hit will occur because of the existance of angular acceleration.

The advantage of the putter described herein is that imperfectly hit golf balls will be less subject to angular acceleration. Accordingly, by reducing or minimizing the effects of error in the putting stroke, the putter provides performance characteristics which will cause even an average golfer to sink more putts, thus improving his game.

Furthermore, no other putter has been constructed to insure that its center of effective mass is as close to the center of the face as possible. Such feature, when combined with the other features, causes the golf ball to putt straighter than any other putter.

Other features and advantages of the invention will be apparent from the following description taken in conjunction with the drawings.

DESCRIPTION OF THE PREFERRED EMBODIMENTS

Figure 1:
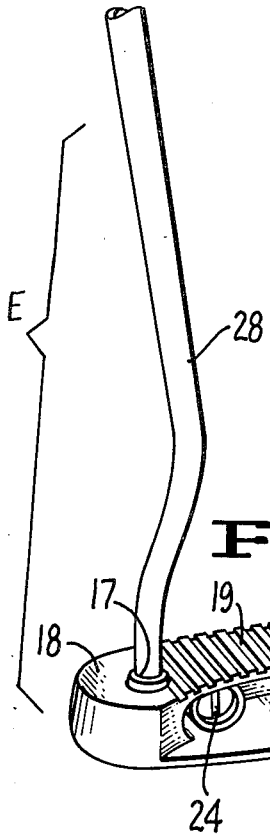
FIG. 1 is a perspective view of one embodiment of a putter in accordance with the present invention.

The golf putter of the present invention is directed both to the physical structure involved and the method by which the physical structures are accomplished, both of which cooperate to produce the intended result. Like reference numerals are used throughout to indicate like parts in the several views.

With reference to the embodiment of the golf putter shown in FIGS. 1 through 5, there is shown a putter head 10 which has a striking face 11 angled rearwardly from the line 12 of the striking face at the lower portion, to the line 14 at the upper portion. The striking face 11 is intended to be defined as the area between the parallel linear lines shown as 12 and 14. For the purposes of this description line 14, referred as line A—B in FIG. 2, will be arbitrarily used as the line of the vertical plane of the face 11 because of the inclination thereof. The top surface 19 may be shaped with a concave curve 15 at its rearward edge and with its lower or foot portion 22 shaped with a convex curve as at 16. A well or boring is provided at 17 for receiving an appropriate shaft 28 in fixed position. The transverse center line of the club head is represented by the line C—D which is also the center line of the striking face 11. It will be observed that the boring 17 for receiving the shaft (not shown) is well rearward of the center line and toward the heel portion 18 of the club head. The toe portion which is upward of the center line C—D is numbered 20. The substantial distance between the toe portion 20 and the heel portion 18 is provided with alternate stripes 21 preferably of contrasting tone, so that a very substantial portion of the top surface area is represented by such stripes 21. The stripes may either be painted on the surface 19, or may be made in the form of wide indentations in the top surface, or both.

Figure 3:
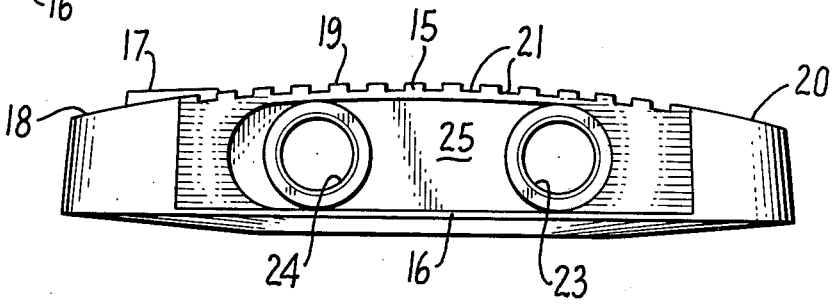
FIG. 3 is a rear elevational view of the putter head of FIG. 2.
Figure 4:
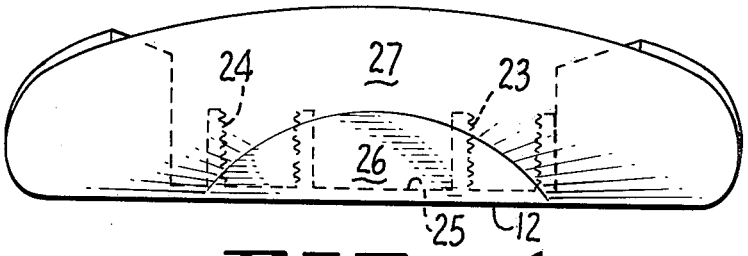
FIG. 4 is a bottom plan view thereof.

Referring now to FIG. 3 it will be noted that the volume of material behind the striking face 11 is eliminated from the rearward side for a substantial distance between the toe 20 and the heel 18 of the club head. This leaves most of the top surface 19 having a fairly thin wall in the distance represented by the extent of the concave curve 15. At the bottom there is a relatively thin foot represented by the convex curve 16 and the material is removed down to a relatively thin wall behind the face 11, so that this portion becomes a cavity open at the rear between the toe and the heel. Interior of this cavity are two rearwardly extending weighting cylinders 23 and 24 for the insertion of removable and adjustable weights. These cylinders are secured to the inner surface 25 of the striking face 11.

Generally, putter heads are made precisely symmetrical around a plane bisecting the plane of the face, in accordance with static considerations. However, the dynamic tests on which this invention are based indicate that such putter heads do not have their effective center of mass at the center of the striking face. Accordingly, a ball struck by such a putter rolls true only when hit at a point near the heel, which indicates there are relevant masses involved in the striking of a golf ball which are exterior to the head itself.

Electronic testing of the dynamic characteristics (i.e., during the impact period) shows that during the period of impact of the club head with the golf ball, shock waves radiate from the point of impact through the putter head and up the shaft to the golfer's hands. This accounts for the "feel" which the golfer has at a very short time interval just after the period of impact. However, high speed photography shows that the ball has left the face of the putter before the golfer feels the impact, so that there is a time interval between impact and the time the golfer feels the impact. This also establishes that the shock waves reach only part way up the shaft before the ball leaves the face of the club, and any reaction after the ball leaves the face of the club is not effective so far as angular acceleration and therefore the ball's behavior are concerned. It is not believed to have been previously discovered or known that a portion of the shaft, which is here termed the effective portion, is to be included as part of the effective mass at the moment of impact. Recognizing this fact, and in order to compensate for the inertial effect of the effective mass of the shaft and to balance the moments of inertia of the effective masses equally at either side of the center of the striking face, the material in the club head is removed between the weighting cylinder 24 and the heel portion 18. The mass of the club head is consequently not symmetrical in that the mass in the heel portion is less than that from the weighting cylinder 23 toward the toe portion 20. It will thus be seen that by removing mass toward the heel portion 18 of the head and taking into consideration the effective portion of the mass of the shaft, is generally represented at E in FIG. 1, the center of effective mass of the putter is established on the line C—D and in the center of the face 11.

Figure 5:
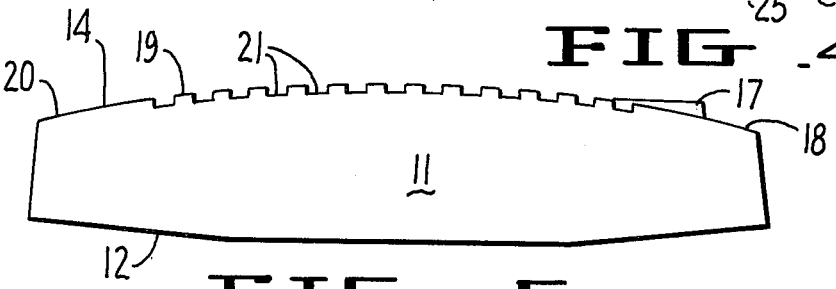
FIG. 5 is a front elevational view thereof.

With reference to the putter of FIGS. 1 through 5, FIG. 4 is a bottom plan view showing the shape of the bottom wall 16. The area symmetrically arced and shown as 26 is flat. The area 27 surrounding it slopes gently rearwardly as well as toward the heel portion 18 and the toe portion 20. FIG. 5 is a front elevation of the striking face which shows a substantial area sloped rearwardly from bottom to top, as indicated above in the description of FIG. 2.

Figure 2:
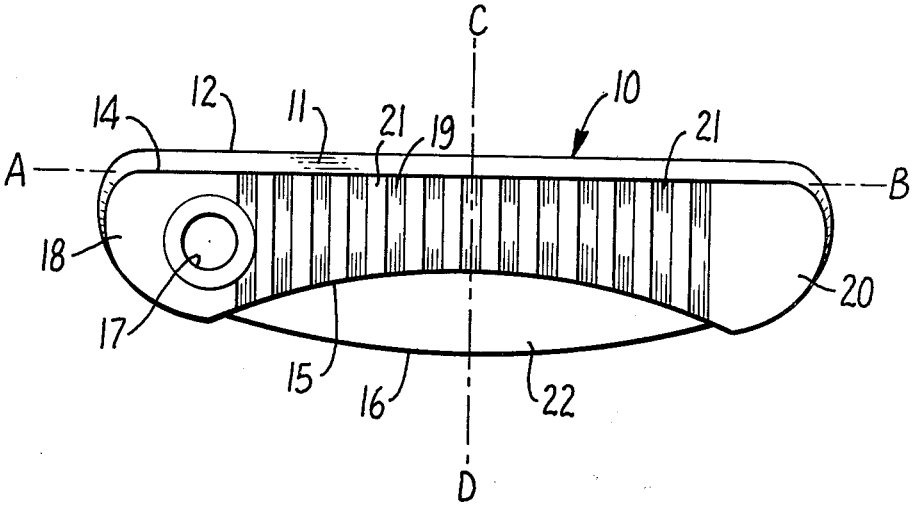
FIG. 2 is an enlarged top plan view thereof, showing the putter head.

It will thus be observed that although the center of effective mass is on the line C—D (as shown in FIG. 2), as close to the center of the striking face 11 as is possible, the club retains a generally symmetrical appearance. To accomplish this, material is removed from the head 10 toward the heel portion 18 to compensate for the effective mass E of the shaft and its mounting in the head. Thus, it is to be observed that as much of the mass has been taken out of the center portion of the head 10 as is possible, with the greater portion of the mass of the head per se being distributed toward the toe and the heel. Tests further show that the effective mass E of the shaft is within the first 25% of its length. Accordingly, the calculation for determining the center of the effective mass includes this portion together with the entire mass of the head.

When weighting is added in the weighting cylinders 23 and 24, the added weights are equal and, since equal, the determination of the center of effective mass is not affected. Moreover, the bulk of the effective mass is maintained as far as possible from the center of the striking face to increase the desired high moment of inertia.

Figure 6:
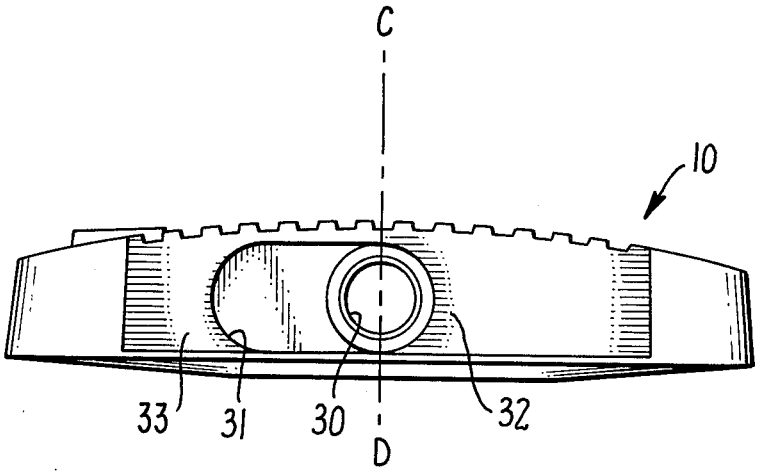
FIG. 6 is a view like FIG. 3 showing another embodiment of the present invention.
Figure 7:
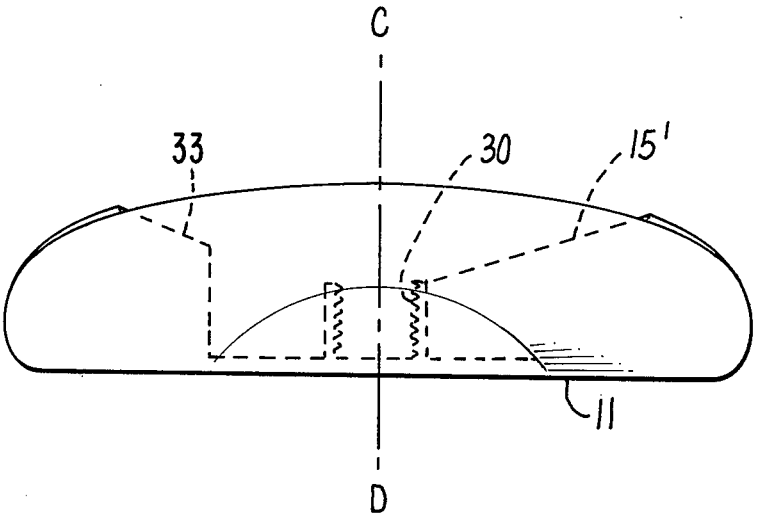
FIG. 7 is a bottom plan view thereof.
Figure 8:
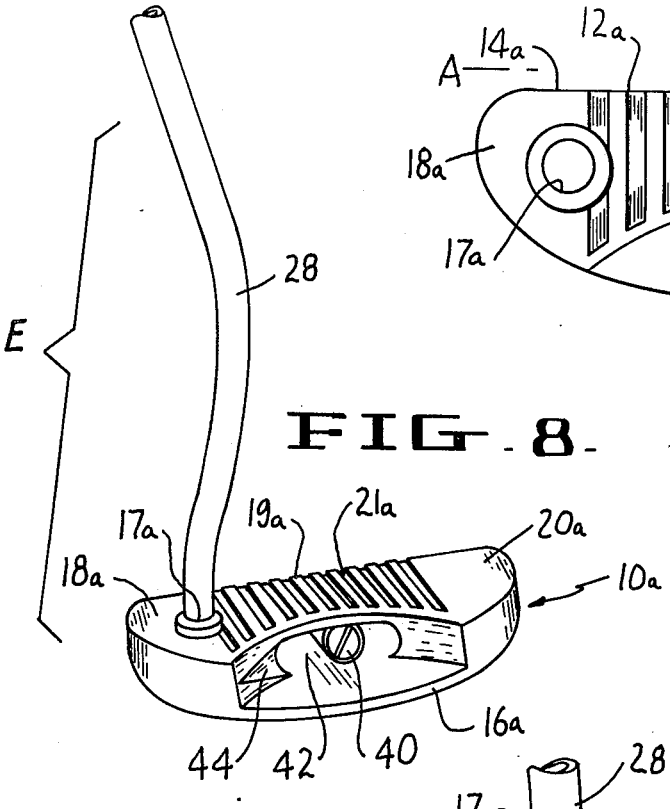
FIG. 8 is a perspective view of still another embodiment of the present invention.
Figure 9:
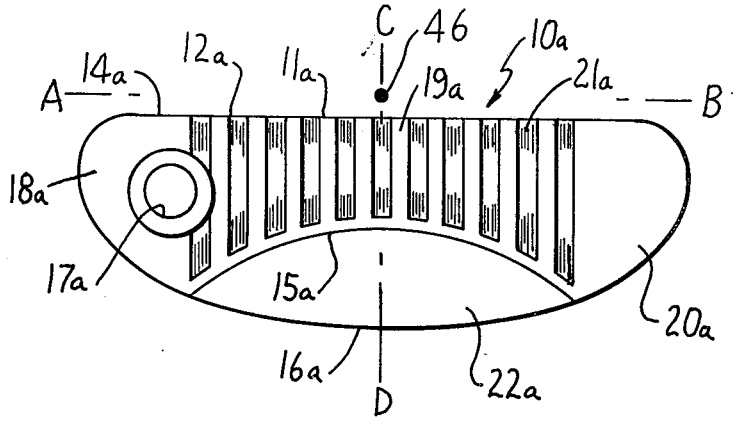
FIG. 9 is an enlarged top plan view of the putter of FIG. 8.

Another embodiment of the golf putter of the present invention is shown in FIGS. 6 and 7.

Referring to FIGS. 6 and 7, the head 10 has only one well 30 for additional weight. The well 30 is located so that its axis corresponds with line C—D (See FIG. 7) which passes centrally of the cavity. The well 30 is therefore substantially in line with the center of effective mass, and otherwise functions substantially in the same manner as wells 23 and 24. As shown in FIG. 7, the rear contour line 15' extends to the toe side of the well 30, leaving the additional substance 32 of the head 10 in position rather than gouging it out as shown in FIG. 1. On the opposite side of the well 30 the metal of the head in the heel portion is retained in place up to the line indicated at 31, and the metal identified at 33 is not removed. This eliminates the necessity for two weight wells without changing in any respect the location of the center of effective mass as corresponding with the center of the striking face 11, or substantially altering the moment of inertia during performance of the putter, or the basic disclosures herein respecting the reduction or minimizing of angular acceleration upon impact.

A still further embodiment of the golf putter of the present invention is shown in FIGS. 8 through 12. As in the preceding embodiment, this further embodiment has only one well 40 for additional weight, such well again being positioned so that its axis corresponds with the line C—D which generally represents a transverse vertical plane bisecting the head. (See FIG. 9).

In comparison to the putters of the preceding embodiments, the head **10*a* of the embodiment shown in FIGS. 8 through 12, is of substantially greater depth in transverse dimension, that is, in directions generally parallel to the transverse center line C—D of the club head. Thus, the distance between the face 11*a* and the rearward edge 16*a* of the foot portion 22*a*** is substantially greater than in the preceding embodiments.

Figure 10:
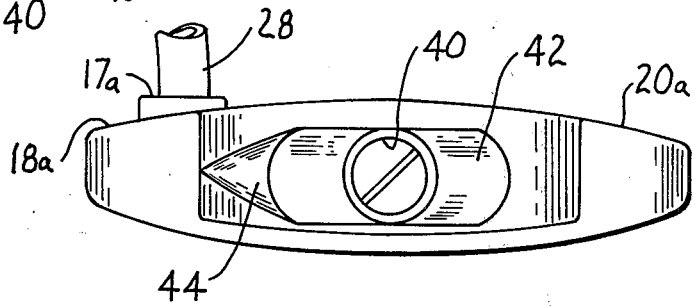
FIG. 10 is a rear elevational view thereof.
Figure 12:
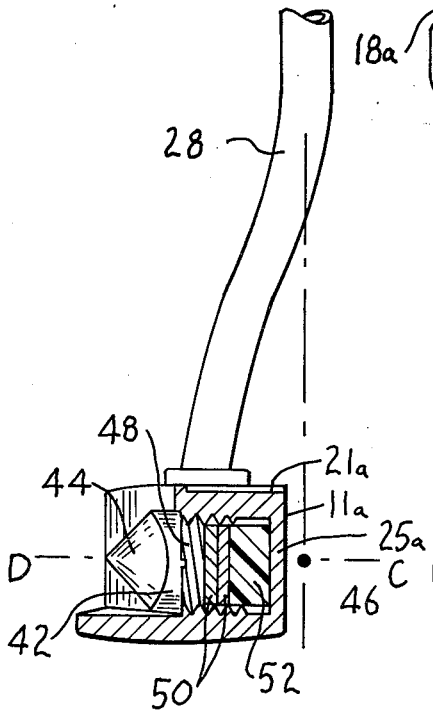
FIG. 12 is a sectional view along the line 12—12 of FIG. 11.
Figure 11:
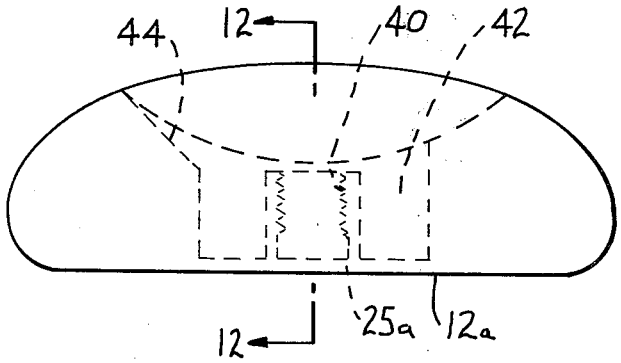
FIG. 11 is a bottom view thereof.

Similarly, the depth of the heel and toe portions **18*a* and 20*a* is substantially greater in dimension. The importance of this difference (as hereinafter described) is that it concentrates a greater proportion of the effective mass of the putter head 10*a* in the heel and toe portions, at a substantial distance from the point defining the center of effective mass of the putter. As in the preceding embodiments, a substantial volume of material immediately behind the striking face 11*a* is removed from the rearward side to provide a relatively large cavity 42 between the toe and heel portions 18*a* and 20*a* of the head. As best seen in FIGS. 10 through 12, a substantially triangular mass of material is also removed from the heel portion of the head, as represented at 44. This removal of material compensates for the effective mass E of the shaft to insure balancing of the moments of inertia of the effective masses equally on either side of the center line C—D through the striking face. Thus, as in the preceding embodiments, mass distribution between the effective portion of the shaft and the components of the putter head is such as to provide a point defining the center of the effective mass of such components along the line C—D. It will be further apparent that positioning the rear opening cavity 42 immediately behind the relatively thin face wall 25*a*** enables the bulk of the effective mass of the putter to be positioned as far as possible from the center of the striking face. The described mass distribution also facilitates the balancing of the moments of inertia of the effective masses (putter head plus effective portion of the shaft) equally on either side of the center of the striking face. Accordingly, during the dynamic reactions of the putting stroke, such construction insures the obtaining of minimum angular acceleration due to maximum moment of inertia and minimum torque during the period of impact.

As is further shown in FIGS. 10–12, the weighting well 40 is centrally positioned with respect to the rear cavity 42, in alignment with the effective center of effective mass along the line C—D. Therefore, if weights are subsequently inserted into the well 40, ther is no change as respects the location of the center of effective mass at the center of the striking face, there is an increase in the moment of inertia of the putter and therefore an increase in the capacity of the putter to resist torque created by an imperfect impact, therefore further minimizing angular acceleration. Having reference to FIG. 12, it can be seen that additional weights can be easily inserted upon removal of the closure member 48. As a practical measure, such added weights (represented by the members 50) are tightly held against a suitable resilient insert 52 (e.g., neoprene) to prevent movement or loosening thereof during repeated putting strokes.

To make the golf putter of the present invention more useful, and to bring out the foregoing advantages, it is preferable to have the offset portion of the shaft rotated in securing the same to the head so that the upper portion of the shaft, above the offset, lies in a plane just ahead of the vertical plane of the striking face represented by the line A—B and on an axis intersecting the line C—D ahead of the center of effective mass, as at point 46. Here again all the forces work together to produce a low torque during the period of impact, with the impact at the center of the striking face. In so doing all of the advantages of this scientifically designed putter are attained in use both by the professional and the amateur. In the designing of a putter, the combining of the effective mass of the shaft with the mass of the head at the moment of impact to determine the center of effective mass, and the locating the center of effective mass at the center of the striking face, have not been foreshadowed by prior teaching or knowledge in any way. On the other hand these features are critical in that they provide a putter which minimizes angular acceleration through minimization of torque and maximization of moment of inertia.

In further explanation of the advantages of the putter construction disclosed herein, it is again noted that the relevant equation is:

$$\alpha = T/I$$

in which $\alpha$ is the angular acceleration (rate of change of twisting), T is the torque of imperfect impact, and I is the moment of inertia of the effective mass of the putter. If the ball is struck on the "sweet spot" (which, as defined herein is the center of the effective mass), there is no twisting i.e., no angular acceleration.

The equation for torque is:

$$T = Fh$$

in which T is torque, F is the force of impact, and h is the distance between the center of effective mass and the line of force of the impact. The following diagram illustrates the effect of this last equation:

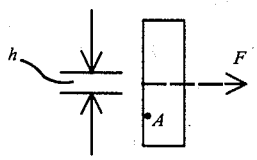

In the diagram F is the force of impact, whereas A is the center of effective mass which is offset from the center of the striking face by the distance h. It has been discovered that to produce a putter of low angular acceleration T must be minimized and to do so, h must be minimized. Clearly if h is zero in the formula $T=Fh$, then T will be zero. Since T is zero, then in the formula $\alpha=T/I$, $\alpha$ is zero. This unexpectedly led to the discovery that if the center of effective mass is established at the center of the striking face, there will be no torque, no angular acceleration, and no deflection of the putt from the target line when the ball is struck at the center of the face. No putter prior to the disclosure here has considered these discoveries, and placed the center of effective mass at the center of the striking face, simultaneously with balancing the moments of inertia of the effective masses in substantially equal components spaced from the center of effective mass.

To recapitulate, the putter disclosed herein minimizes angular acceleration by minimizing torque and maximizing moment of inertia. Torque is minimized by the placement of the center of "effective" mass at the center of the face. This is done by equalizing the moments of inertia of the "toe" and "heel side" "effective" masses about the center of the face, recognizing and defining the "effective" mass of the shaft. The moment of inertia is maximized by distributing mass away from the center of effective mass, subject to the constraints of the previous goals and of commercial acceptability.

What is claimed is:

1. In a method of making a putter having equalized components of effective mass so as to minimize angular acceleration imparted to the ball during the period of impact, said putter including a head and a shaft, the steps of preparing said head with a striking face, toe, heel and central portions, removing portions of the mass of material immediately behind said central portion of said head to form a rearward opening cavity, determining the effective mass of of the toe portion of said head in relation to a vertical plane extending through a point at the center of said striking face, determining the effective mass of the heel portion of said head plus that portion of the shaft extending upward from said heel portion which feels the shock waves during the period of impact of the club head with the ball, said last determination also being in relation to said vertical plane extending through said point at the center of the striking face, removing material from the heel portion of said head so that the effective mass of said heel portion plus said shaft portion equals the effective mass of said toe portion to thereby balance the effective mass components on either side of said vertical plane through said point at the center of said striking face and, also, the moments of inertia of said effective mass components with respect to said vertical plane, to thereby effectively minimize angular acceleration imparted to the ball by said putter throughout the period of impact.

2. In the method of claim 1, the further step of securing equal and opposite weight receiving cylinders in said cavity as respects said vertical plane through the point at the center of said putter face, said weight receiving cylinders facilitating an increase in the total mass of the putter according to the user's taste without changing the equal relationship of the effective mass components.

3. In the method of claim 1, the further step of securing a single weight cylinder in said cavity for increasing the total mass of the putter in such fashion as to maintain the equal relationship of said effective mass components with respect to said vertical plane, said single weight cylinder being behind and in substantial axial alignment with said point at the center of said striking face.

4. In the method of claim 1, the further step of mounting the shaft on said putter head so that the axis of an upper extending portion of said shaft is positioned at an angle to intersect said bisecting vertical plane ahead of said point at the center of said striking face.

5. In the method of claim 1, the further steps of mounting a shaft which has reverse curves at its lower end in said puter head, face-balancing said putter by rotating said shaft on its axis in said head until the striking face of said putter head when the putter is balanced parallel to the ground is also parallel to the ground and the upper portion of said shaft above said curves is ahead of the vertical plane of said striking face, and securing said shaft in said head in said face balanced position.

6. The method of making a putter characterized by an equalized distribution of effective mass components as respects a vertical plane passing through a point at the center of the striking face of said putter, to thereby minimize angular acceleration imparted to the ball during its impact, said putter including a head and a shaft, the steps of preparing a head having a striking face, toe, heel, and central portions, removing a substantial mass of material immediately behind the striking face at said central portion of said head to form a rearward opening cavity, determining the effective mass of the toe portion of said head in relation to said vertical plane extending through said point at the center of said striking face, determining the effective mass of the heel portion of said head plus that portion of the shaft extending upward from said heel portion which feels the shock waves during the period of impact of the club head with the ball, said last determination also being in relation to said vertical plane extending through said point at the center of the striking face, removing material from the heel portion of said head so that the effective mass of said heel portion plus said shaft portion equals the effective means of said toe portion, thereby equalizing the effective mass components on either side of said vertical plane through said point at the center of said striking face, and, also, the moments of inertia of said effective mass components, thereby to effectively minimize angular acceleration imparted to the ball by said putter throughout the period of impact, and positioning substantial and equalized portions of said effective mass components as far as possible from said point at the center of the striking face of said putter so as to increase the total effective mass and moment of inertia of said putter without changing the equal relationship between said effective mass components and their moments of inertia.

7. In the method of claim 6, the further step of positioning weight receiving cylinders in said toe and heel portions of the head and at equally spaced positions as respects said vertical plane through said point at the center of the striking face, said cylinders facilitating an increase in the total mass of said putter without change in the equal relationship of said effective mass components.

8. A golf putter having a shaft and a head with a striking face, said putter being constructed to have a predetermined precisely balanced effective mass which is operable during the putting stroke, said effective mass constituting those portions of the head and shaft of the putter within which shock waves are felt during an impact period related to the putting stroke which commences with contact of the ball with the striking face and extends until the ball leaves the striking face, said putter being particularly constructed to provide balanced components of said effective mass with respect to a vertical plane extending through a point in the center of said striking face and which bisects said face, said balanced components of said effective mass consisting of a first effective mass component toeward of the plane vertically bisecting the face and of a second effective mass component heelward of said plane bisecting said face, said second effective mass component also including a substantial portion of the shaft less than the full length thereof within which said shock waves are felt during the impact period of said putting stroke, said balanced components of the effective mass including club head portions which are of unequal mass in that the mass of the toeward portion of the head is greater than the mass of the heelward portion of the head, the greater mass of said toeward portion being balanced as part of said effective mass during the impact period of the putting stroke by the mass of that portion of the shaft which feels the shock waves during said impact period, whereby the moments of inertia of said first and second effective mass components are at all times equal and balanced about said point at the center of the striking face during the impact period of said putting stroke.

9. A golf putter as in claim 8 wherein said portion of the shaft included in said second effective mass component extends upward within the first 25% of the length of the shaft above said head.

10. A golf putter as in claim 8 wherein the mass of each of said balanced components of said effective mass is increased through placement of additional mass particles within each of said first and second effective mass components, at substantial and equalized distances from said center of the striking face, to thereby increase the moments of inertia of said balanced components of said effective mass without changing the balanced condition thereof.

11. A golf putter as in claim 10 wherein said additional mass particles comprise two equally spaced weight receiving cylinders, one positioned within said first effective mass component and the other within said second effective mass component, said weight receiving cylinders being constructed to be of equal mass and positioned within the structural configuration of said head so as to be spaced at equal but maximum distances from said vertical plane.

12. A golf putter as in claim 11 wherein weights are selectively positioned within each of said weight receiving cylinders, the mass distribution thereof being such as to maintain the balanced condition of said balanced components of said effective mass.

13. A golf putter as in claim 11 wherein said additional mass particles comprise a single weight receiving cylinder positioned in said head so as to be axially aligned behind said point at the center of the striking face and having its axis aligned within said vertical plane.

* * * * *